US006849814B2

(12) United States Patent
Ogden

(10) Patent No.: US 6,849,814 B2
(45) Date of Patent: Feb. 1, 2005

(54) ADJUSTABLE THREE-AXIS GRAVITY SWITCH

(75) Inventor: Everett Ogden, Ponte Vedra Beach, FL (US)

(73) Assignee: PAR Technology, Inc., Jacksonville Beach, FL (US)

( * ) Notice: Subject to any disclaimer, the term of this patent is extended or adjusted under 35 U.S.C. 154(b) by 0 days.

(21) Appl. No.: 10/386,193

(22) Filed: Mar. 11, 2003

(65) Prior Publication Data

US 2003/0168326 A1 Sep. 11, 2003

Related U.S. Application Data

(60) Provisional application No. 60/363,469, filed on Mar. 11, 2002.

(51) Int. Cl.[7] ..... H01H 29/20
(52) U.S. Cl. ..... 200/61.46
(58) Field of Search ..... 200/61.45 R, 61.46, 200/61.47, 61.52, 286

(56) References Cited

U.S. PATENT DOCUMENTS 3,836,739 A * 9/1974 Endo ..... 200/61.47
4,107,545 A * 8/1978 Gittelis ..... 200/61.45 R
5,694,113 A * 12/1997 Chen ..... 200/61.52
5,911,635 A 6/1999 Ogden
6,281,456 B1 8/2001 Ogden
6,448,517 B1 9/2002 Ogden
6,452,121 B1 9/2002 Ogden
6,455,790 B1 9/2002 Ogden
6,486,422 B2 11/2002 Ogden

* cited by examiner

*Primary Examiner*—Renee Luebke
(74) *Attorney, Agent, or Firm*—Thomas C. Saitta

(57) ABSTRACT

A gravity-type sensor device comprising a switch which monitors the position of an object over a three dimensional pathway which extends dimensionally about all three orthogonal axes where the object may be tilted, rotated or inverted, as well as translated through space rather than maintained at a fixed location, so as to provide a signal to indicate that the object is moving in the correct three dimensional manner, whereby the switch is disposed within an external housing in a manner that allows the position of the switch to be altered relative to the housing, thereby allowing the angle or plane of the pathway to be adjusted when the housing is attached to different objects.

22 Claims, 12 Drawing Sheets

ADJUSTABLE THREE-AXIS GRAVITY SWITCH

This application claims the benefit of U.S. Provisional Patent Application Ser. No. 60/363,469, filed Mar. 11, 2002.

BACKGROUND OF THE INVENTION

This invention relates to sensors or switches which utilize the fact that gravity will maintain an unrestricted conductive contact element, such as a metal ball or a ball of liquid mercury or other electrically conductive liquid, in the lowermost position relative to its containment chamber to indicate attitudinal position of the switch or sensor relative to true vertical, and correspondingly the attitudinal position of any object attached thereto. More particularly, the invention relates to such a sensor which is able to monitor the attitudinal position of an object relative to true vertical over a three axis pathway, such that a single sensor can monitor the movement over the pathway even if the object and sensor are inverted or tilted in any plane, and regardless of whether the object is fixed in space or moved positionally. Even more particularly, the invention relates to such a sensor where the operational sensor means is adjustable relative to a housing adapted to be connected to an object, such that the three axis pathway may be adjusted to account for attachment of the housing to a different object.

There are many situations where it is necessary or desired to monitor or sense the attitudinal position of an object relative to true vertical. Switches or sensors which utilize the effect of gravity on a ball of liquid mercury or an electrically conductive metal ball or roller are well known, the switch being designed such that the unrestricted conductive member makes or loses contact with a pair of leads in an electrical circuit dependent on the attitude of the switch relative to true horizontal, such that either contact with the leads or loss of contact with the leads which occurs when the attitudinal position of the switch is altered relative to vertical results in a signal or other electrical action occurring. Such switches or sensors are commonly referred to as mercury or gravity switches. Such simple gravity switches work when the object or switch is tilted or rotated about a non-vertical line, such that the switch is activated or deactivated when a particular angle relative to vertical is exceeded and gravity causes movement of the conducting ball away from or against the contact leads. In order to track attitudinal positioning of an object along various curved pathways in the orthogonal X-Y-Z three axis world, where the switch is rotated, tilted and/or inverted, the known solution is to attempt to combine a number of such two dimensional switches, with the switches oriented in opposing directions. Any such solution, especially when the object is inverted, requires determination of sequential activation and deactivation scenarios, since certain of the switches will be non-functional or provide incorrect signals when the object passes through various positions relative to vertical.

Switches of this type suitable for use in this invention are disclosed in my earlier and commonly owned U.S. Pat. No. 6,281,456, issued Aug. 28, 2001, U.S. Pat. No. 6,448,517, issued Sep. 10, 2002, U.S. Pat. No. 6,452,121, issued Sep. 17, 2002, U.S. Pat. No. 6,455,790, issued Sep. 24, 2002, and U.S. Pat. No. 6,486,422, issued Nov. 26, 2002, the disclosure of all being incorporated herein by reference.

It is an object of this invention to provide a sensor device having a single gravity-type sensor switch which monitors the position and orientation of an object over a three dimensional pathway which extends dimensionally about all three orthogonal axes, where the object may be tilted, rotated or inverted, as well as translated through space rather than maintained at a fixed location, so as to provide a signal to indicate that the object is moving in the predetermined three dimensional pathway, whereby the switch is disposed within an external or secondary housing in a manner that allows the position of the switch to be altered relative to the housing, thereby allowing the angle or plane of the pathway to be adjusted when the housing is attached to different objects. It is a further object of this invention to provide such a switch where the pathway is rotatably or pivotally adjustable relative to the housing about an axis, such that the pathway may be altered relative to one or more directions to increase the adaptability of the switch to changing circumstances.

SUMMARY OF THE INVENTION

The invention is a gravity-type sensor device having a switch in which a gravity responsive member remains in the lowermost portion of a retaining chamber as the switch is moved through space. The gravity responsive member, which may be a ball of liquid mercury or other conductive liquid, an electrically conductive solid metal ball or roller, or similar type object, is retained within a defined curvilinear chamber having at least one conductive pathway mounted along one of the walls of the chamber which allows for relative movement between the gravity responsive member and the pathway as the attitudinal position of the switch relative to true vertical changes, true vertical being defined as the line passing through the switch and the gravitational center of the earth. A sensing pathway is formed along the curved walls such that a completed electrical circuit is produced when the sensing pathway is moved to be in contact with the gravity responsive member. The sensing pathway may comprise a number of discrete contact points or lead pairs positioned along the pathway, or it may comprise a pair of continuous conductive strips or wires, either embedded on the surface of the walls or disposed into the interior of the chamber, or it may comprise a single set of contact points, a wire or a strip in combination with a conductive surface on the curved wall of the chamber, or may comprise a conductive surface coating applied to one or both of opposing surfaces or chamber walls. The chamber walls may comprise the interior wall of a curved tube, such as a 360 degree torus having a circular transverse cross-section, or a pair of curvilinear, equidistantly spaced walls having matching surfaces, or a hemisphere or a spherical surface. The wall pairs may comprise a sphere within a sphere, a section of a sphere within a sphere, or any configuration of paired curvilinear walls. The curved tube may comprise a portion of a circle or may be spiraled or curved in multiple curves of differing radii.

The sensing pathway occupies at least two orthogonal dimensions and enables the sensor to function regardless of tilt, rotation or inversion. The particular sensing pathway is determined by the desired positional movement of the object to be monitored. The zero position, defined to be the position of the gravity responsive member relative to the remaining components of the sensor at any moment in the movement path of the object, i.e., the lowest possible position for the gravity responsive member within the retaining walls for a given attitudinal position, is determined for the object's entire movement pathway. With this information, the proper sensing pathway can be constructed on the chamber walls so that as the object is moved through three dimensions, the sensor pathway will be repositioned relative to the gravity responsive member, which has a fixed spatial attitude due to gravity. As long as the object is moved in the correct pathway, the gravity responsive member will remain in contact with the sensing pathway and the electrical circuit will be maintained. If the object is moved out of the predetermined pathway, the gravity responsive member will not remain in contact with the sensing pathway and the circuit will be broken. Alternatively, the sensor can be designed such that movement in the proper pathway results in no contact with the contacting element, with the sensing pathways arranged to provide a complete circuit only when the object is incorrectly moved. The presence or absence of an electrical circuit is used to provide a signal or indication, or can be used to actuate other electrical devices to effect desired results. The switch may also be constructed using optical components such as a combination of photosensors and defined light sources, receivers and emitters, whereby the gravity responsive element becomes an opaque blocking element between the light sources and the photosensors when properly positioned.

The relative position of the switch to the housing which is to be connected to an object is adjustable about an axis, such that the pathway may be altered by repositioning the pathway relative to the housing. In this manner the pathway can be adjusted for a more precise orientation, or the pathway may be changed from an orientation suitable for connection to a first object, then altered to an orientation suitable for connection to a second or plural number of objects. For example, in a switch as defined and having a housing designed to be attached to the shaft or grip of a golf club for swing training purposes wherein an ideal swing pathway is monitored by the switch, the orientation of the switch operational components relative to the housing may be adjusted so that the swing plane defined by the switch pathway will remain appropriate for either a driver, a middle iron or a short iron, since the lie angles of the clubs and shafts vary slightly due to the different lengths of the club shafts.

DETAILED DESCRIPTION OF THE INVENTION

Figure 34:
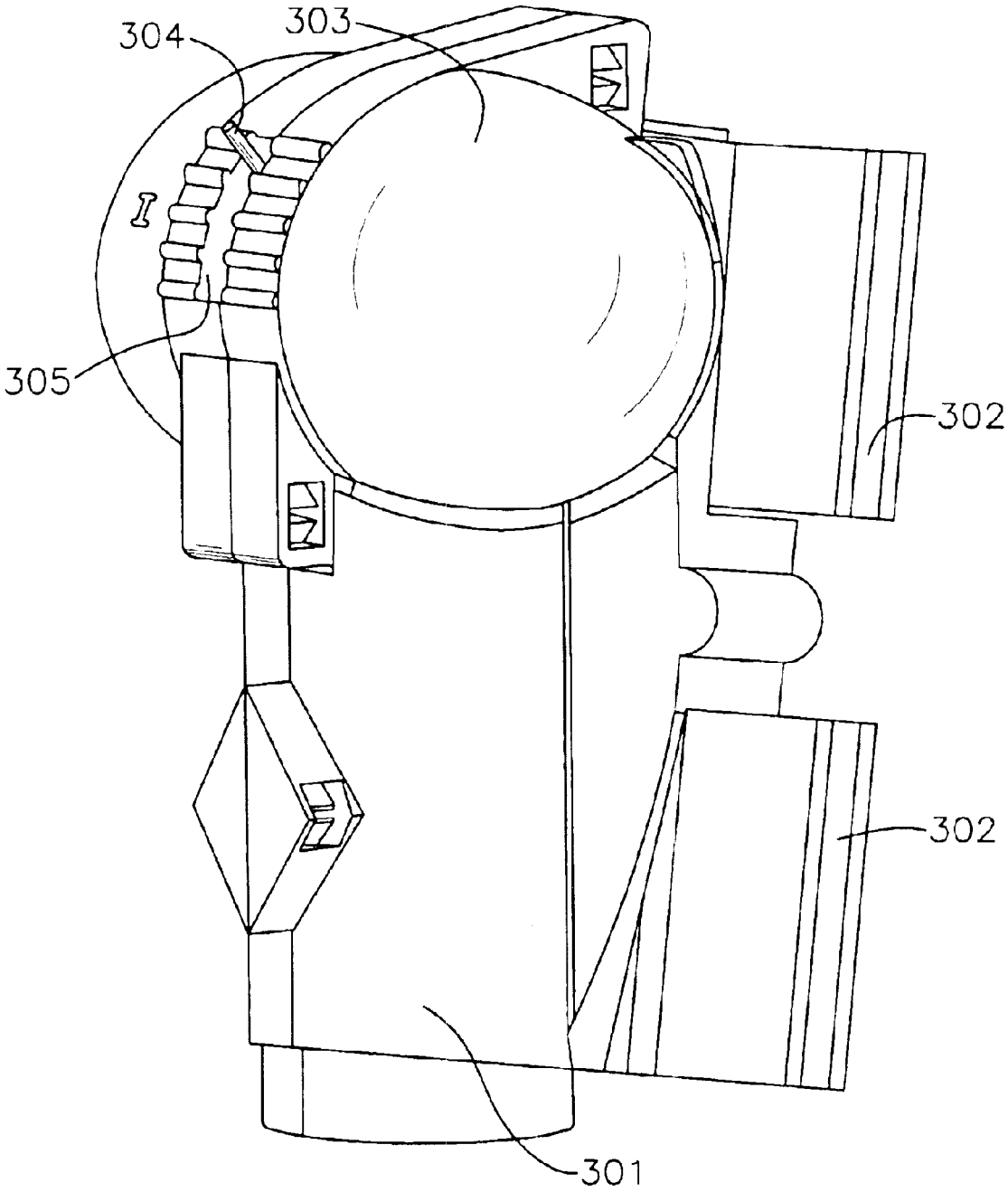
FIG. 34 is a perspective view of the embodiment of the invention where the housing is adapted for attachment to the shaft of a golf club, and whereby the switch is adjustable relative to the housing in order to change the orientation of the pathway.
Figure 35:
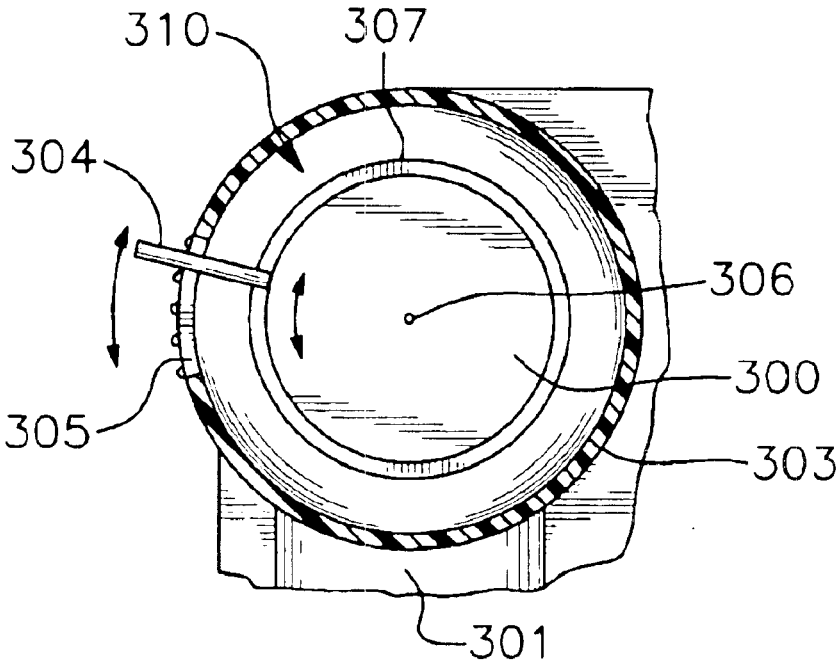
FIG. 35 is a partially exposed and cross-sectional end view taken along the pivot axis of the switch showing a sleeve as the pivoting means for the switch within the housing.
Figure 36:
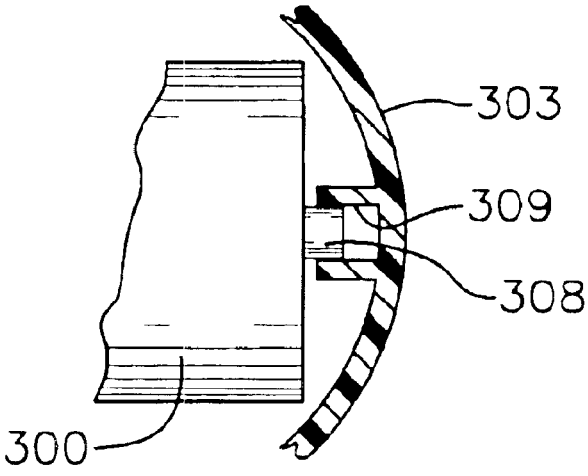
FIG. 36 is a partially exposed and cross-sectional side view showing a post and recess as the pivoting means for the switch within the housing.

The invention will now be described in detail with regard for the best mode and preferred embodiment, reference being made to the accompanying drawings. Generally, the invention is a gravity-type sensor device comprising a switch which monitors the position of an object over a three dimensional pathway which extends dimensionally about all three orthogonal axes where the object may be tilted, rotated or inverted, as well as translated through space rather than maintained at a fixed location, so as to provide a signal to indicate that the object is moving in the correct three dimensional manner, whereby the switch is disposed within an external housing in a manner that allows the position of the switch to be altered relative to the housing, thereby allowing the angle or plane of the pathway to be adjusted when the housing is attached to different objects. FIGS. 34 through 36 depict the structural relationship between the switch and the housing, while FIGS. 1 through 33 depict suitable and preferred switch structures.

In general, the invention comprises a switch, or when in combination with suitable power and signal or control elements, a sensor, having a chamber 40 having opposing curved walls 41 to retain a gravity responsive member 12 which is free to move within the chamber 40 and which occupies the lowermost position in the chamber 40, and a conductive sensing pathway 30 along at least one of chamber walls 41 and typically on opposing walls 41, or suspended within the interior of chamber 40, the pathway 30 extending in three dimensional directions, where the pathway 30 defines a course of rotation over all three axes for the switch such that the gravity responsive member 12, dependent on the orientation of the switch relative to true vertical, either contacts or does not contact the pathway 30, thus either completing or opening a circuit. The sensing pathway 30 is connected in standard manner to an operational electrical or electronic circuit such that the device operates as a switch to activate or deactivate a given operation.

As seen in FIGS. 1 through 6 and 8 through 9, the switch comprises a tubular member 11 with closed ends which define curved opposing walls to retain the gravity responsive member 12. Tubular member 11 is preferably constructed of non-conducting material such as plastic. The gravity responsive member 12 is a conductive member, preferably consisting of a ball of liquid mercury, but the device may also be constructed using an electrically conductive metal ball or roller, or like object, which completes an electrical circuit when in contact with a conductive sensing pathway 30.

Figure 1:
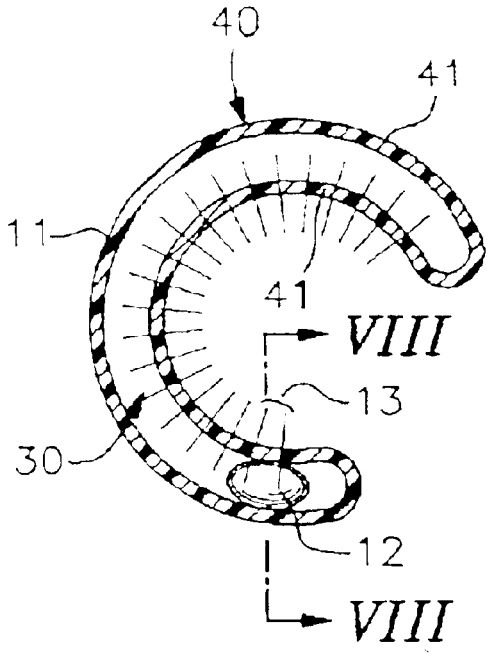
FIG. 1 is view of the tubular embodiment of the invention, showing the contact pathway as a series of discrete lead pairs.
Figure 3:
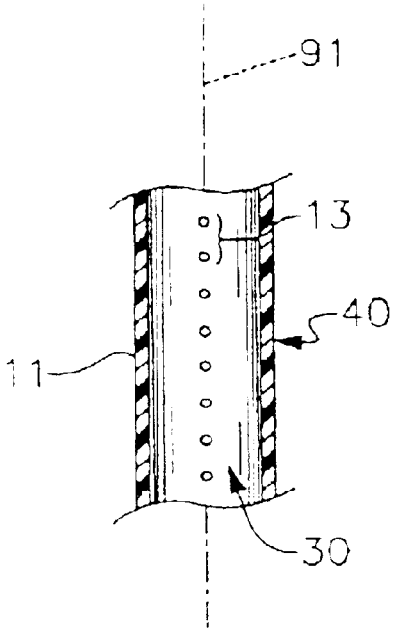
FIG. 3 is a cross-sectional view of a section of FIG. 1, showing the sensing pathway as positioned on the radial line.
Figure 8:
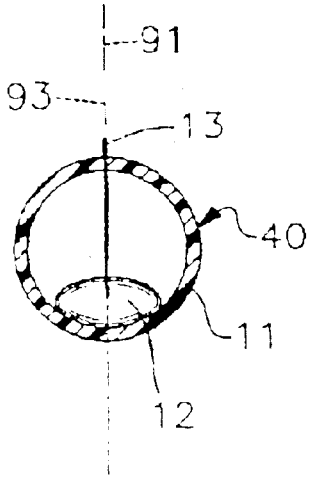
FIG. 8 is a cross-sectional view taken along line VIII—VIII of FIG. 1, showing the positioning of the gravity responsive member relative to the sensing pathway when the sensing switch is maintained in the proper position.
Figure 9:
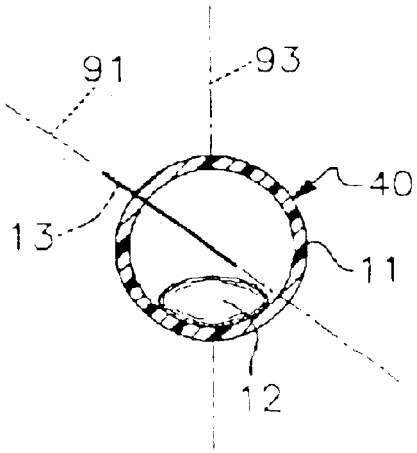
FIG. 9 is a cross-sectional view similar to FIG. 8 showing the positioning of the gravity responsive member relative to the sensing pathway when the sensing switch is tilted beyond the proper positional alignment.

FIGS. 1 and 3 illustrate a simple version of the sensor switch, where the pathway 30 comprises paired pin contact electrical lead members 13 extending into the interior of the chamber 40 through a curved wall 41, which although not shown would be arranged in circuit with an electrical power source, such as a battery, such that when the gap between any paired set of electrical leads 13 is closed by contact of the gravity responsive member 12, the current will flow to produce a desired electrical response, such as a signal or indication. The electrical leads 13 are arranged along the radial line 91 taken from the midpoint of the circle enclosed by tubular chamber 40 which bisects the chamber 40, as shown in FIG. 3. The radial line 91 and thus the conductive pathway 30 is in the plane of the circle. As the switch is rotated about its central axis, the gravity responsive member 12 remains at the lowermost position relative to true vertical 93, and successive pairs of leads 13 come into contact with the gravity responsive member 12 so long as the switch, and the object to which the switch is attached, is rotated within the vertical plane, as shown in FIG. 8. If however the switch is tilted out of the proper plane of rotation, then the gravity responsive member 12 will no longer contact the leads 13 and the electrical circuit will be broken, as shown in FIG. 9.

Figure 2:
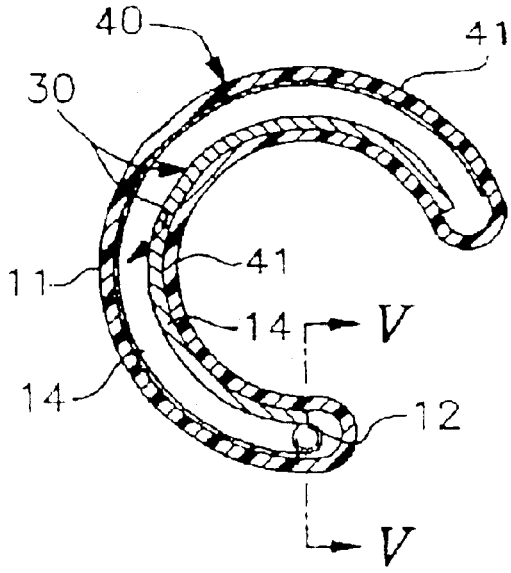
FIG. 2 is a view of the tubular embodiment showing the sensing pathway as a pair of opposing conductive strips.
Figure 5:
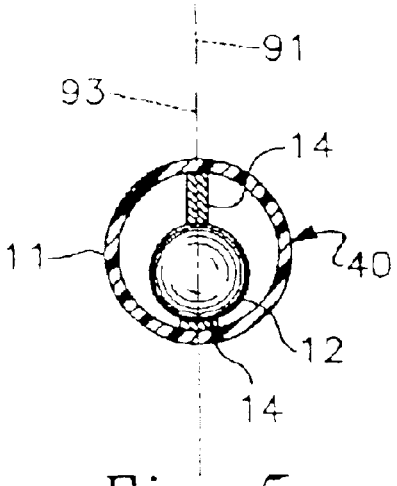
FIG. 5 is a cross-sectional view taken along line V—V of FIG. 2, showing the positioning of the gravity responsive member relative to the sensing pathway when the sensing switch is maintained in the proper position.
Figure 6:
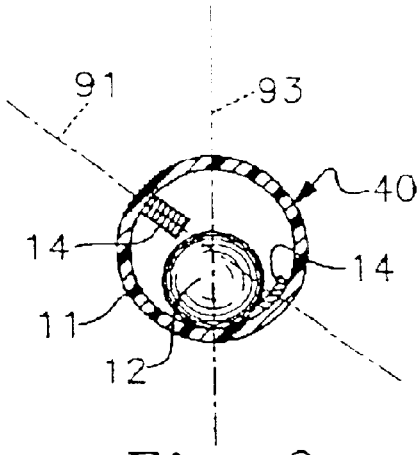
FIG. 6 is a cross-sectional view similar to FIG. 5 showing the positioning of the gravity responsive member relative to the sensing pathway when the sensing switch is tilted beyond the proper positional alignment.

FIG. 2 shows an alternative embodiment, where the sensing pathway 30 is formed by a set of opposing strips 14 which extend out from the opposing curved walls 41 of the chamber 40. Here the opposing strips 14 would be connected in a powered electrical circuit, not shown, such that a closed electrical circuit is created from one strip 14 to the opposing contact strip 14 through gravity responsive element 12, a metal ball. FIGS. 5 and 6 illustrate respectively a closed electrical circuit with the sensing switch maintained in the proper alignment and an open electrical circuit when the switch is tilted improperly such that contact between the conductive pathway 40 and the gravity responsive element 12 is broken.

Figure 4:
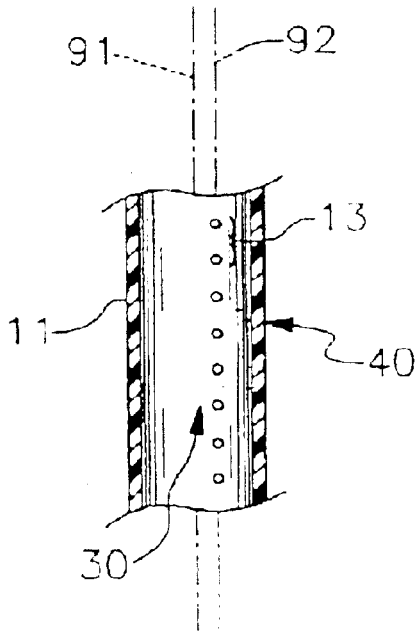
FIG. 4 is a view similar to FIG. 3, showing the sensing pathway as positioned some degrees off the radial line.
Figure 10:
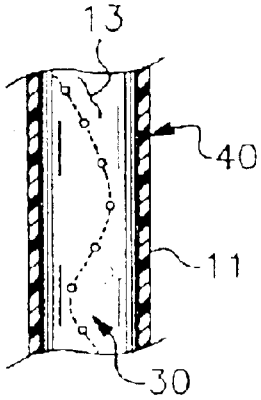
FIG. 10 is a view similar to FIG. 3, where the sensing pathway is curvilinear and formed of electrical lead pairs.
Figure 11:
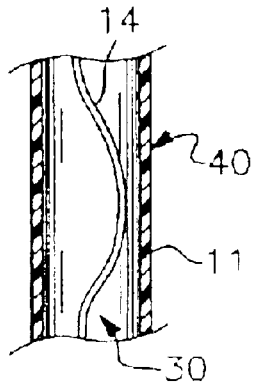
FIG. 11 is a view similar to FIG. 3, where the sensing pathway is curvilinear and formed of a conductive strip material.
Figure 12:
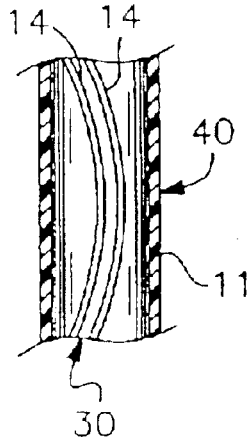
FIG. 12 is a view similar to FIG. 3, where the sensing pathway is a pair of curvilinear strips.
Figure 13:
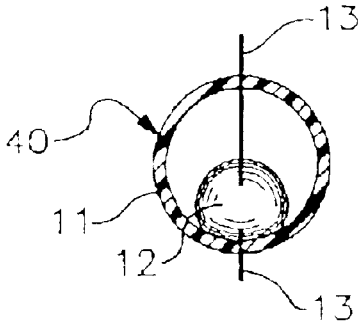
FIG. 13 is a view similar to FIG. 3, showing electrical contact leads positioned on opposing walls.

As depicted in FIGS. 1 and 2, the switch can be rotated through approximately 270 degrees without loss of function. The tubular member 11 could be constructed of shorter or longer arc lengths, and could even be configured as a full 360 degree ring. This embodiment functions to sense attitudinal position relative to true vertical 93. The sensitivity of the switch, i.e., the angular variation allowed from true vertical before electrical contact is broken is determined by the length of the extension of the contact leads 13 into the interior of the tube 11 and the size of the gravity responsive element.

Where the desired movement pathway of the object is planar but not vertical, as in the case of a golf swing, the placement of the contact leads 13 is altered as shown in FIG. 4. For example, a proper golf swing for any of the full distance shots requires that the club be rotated approximately 270 degrees from a zero degree starting position with the club held straight down, then brought backwards through horizontal, past vertical to an almost horizontal stopping point, with the swing pathway reversed in order to strike the ball. In addition, the swing plane is tilted from true vertical about 30 to 45 degrees and each portion of the club changes its position in space, i.e., there is no point on the club itself corresponding to a single fixed axis or fixed pivot point. Monitoring of the entire swing with regard for the proper swing plane is desirable to ensure that the swing is properly made. Here the leads 13 forming pathway 30 are not positioned along radial line 91 but instead are positioned along offset line 92, which is a predetermined number of degrees from radial line 91. With this construction, the proper movement pathway is on a slanted plane, and the sensing pathway 30 defined by the contact leads 13 mimics that plane relative to true vertical. If the switch is maintained at the proper alignment angle, even during inversion and position change through 270 degrees, the gravity responsive member 12 will remain in contact with the pathway 30 and an electrical circuit will be maintained.

Where the desired movement pathway is not planar but occurs over a three axis pathway, similar adjustments are made to the sensing pathway 30 along the length of the tubular member 11. Any sort of curving, spiraling or even abrupt angle change in the desired movement pathway is mimicked by the pathway 30, such that the sensing pathway 30 corresponds to the desired object movement pathway, such as shown in FIGS. 10 through 12. In FIG. 10, the sensing pathway 30 is formed of contact pin pairs 13, where the circuit is closed when the gravity responsive member 12 connects any given pair of pins 13. In FIG. 11, the sensing pathway 30 is comprised of a pair of strips 14, where the circuit is closed when the gravity responsive member 12 connects the gap between the strips 14. FIG. 12 shows the pathway 30 as formed by two sets of spaced conductive strip pairs 14 where the circuit is open when the switch is maintained in the proper position and closed should the gravity responsive member 12 contact either pair of strips 14 of pathway 30. The strips 14 can be preformed wires or foil members which are adhered or bonded to the wall of the chamber 40 in suitable known manner, or the strips 14 may be created directly on the wall of the chamber 40 by suitable known deposition techniques, such as masked spraying. Alternatively, the strips 14 may be created by forming the chamber 40 of a conductive material and mask spraying a non-conductive coating onto the wall of the chamber 40 with the strips 14 left as exposed members. With these constructions, the switch can be rotated, inverted and tilted through differing angles from true vertical. The gravity responsive member 12 remains at the zero position throughout all the switch movement, and maintains the completed electrical circuit so long as it is in contact with the pathway 30.

Figure 7:
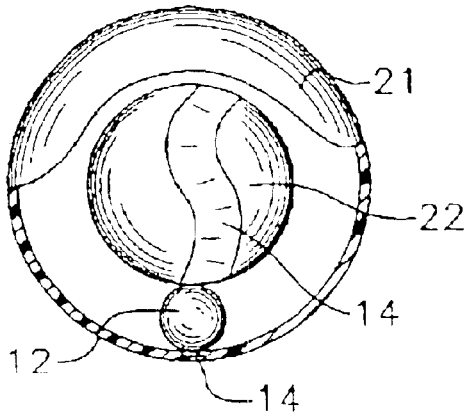
FIG. 7 is a partially exposed view of an embodiment of the invention where the pathway walls are formed by a pair of spherical surfaces.
Figure 30:
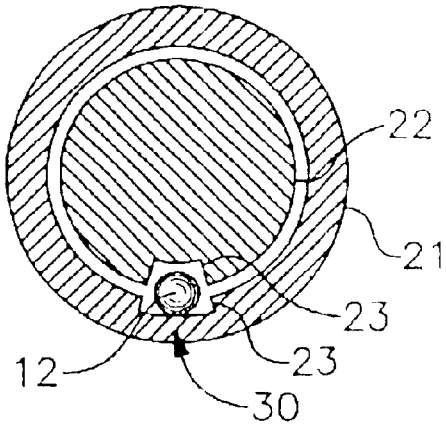
FIG. 30, is a cross-sectional view of a spherical switch where the sensing pathway is formed by a pair of channels.

In another alternative embodiment, shown in FIG. 7, the tubular member 11 is replaced by an inner spherical surface 22 inside an outer spherical surface 21, each defined as portions of a sphere. The gravity responsive member 12 will always remain at the lowermost gravity position as the switch is turned in any direction. As before, sensing pathway 30 is laid out to correspond to the desired movement pathway of the switch. The switch can be constructed with contact lead pins 13 and a liquid mercury contact element 12 as discussed above, of may be constructed as shown in the drawing using a pair of opposing contact strips 14 to form the pathway 30 with the circuit completed by a metal ball or liquid mercury gravity responsive member 12. If the switch is turned such that the gravity responsive member 12 does not contact both strips 14, the circuit will be broken. As before, any desired movement pathway can be replicated on the surfaces of 21 and 22. An alternative embodiment is shown in FIG. 30, where the sensing pathway 30 is formed by a pair of opposing grooves or channels 23, with the surfaces 21 and 22 being formed of a conductive material. When the metal ball gravity responsive member 12 contacts either of the sides of the channels 23, the circuit is completed.

Figure 14:
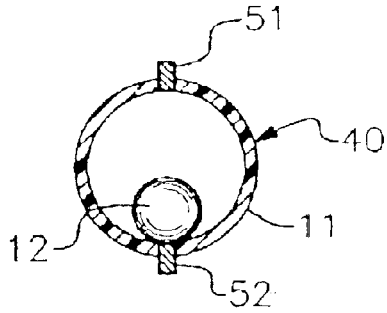
FIG. 14 is a view similar to FIG. 3, showing the pathway formed by optical emitters and receivers.
Figure 15:
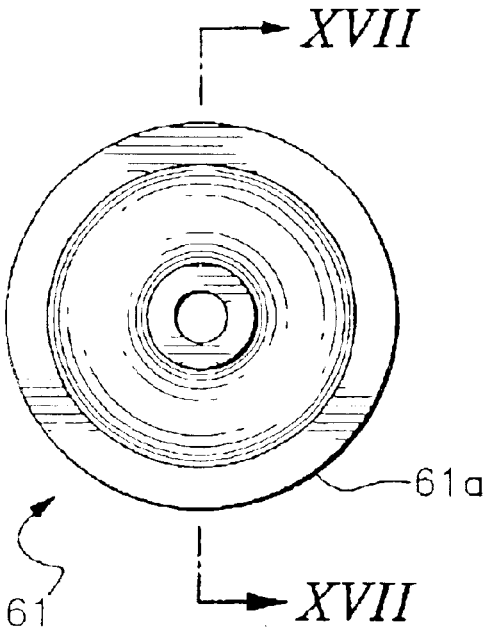
FIG. 15 is a side view of a switch configured as a 360 degree torus which is circular in transverse cross-section.
Figure 16:
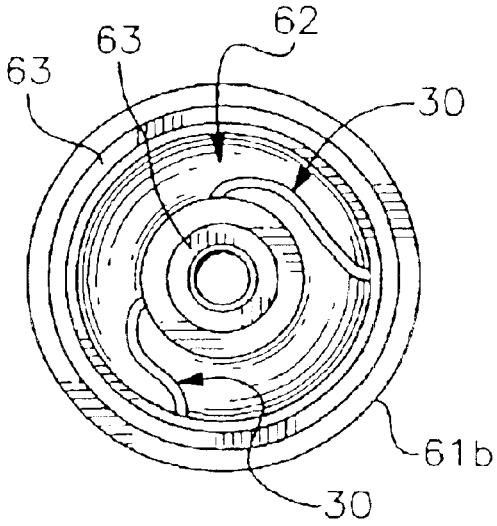
FIG. 16 is an interior view of one half of the body of the switch of FIG. 15.

Another alternative embodiment for this type of sensing switch involves the use of optical circuits rather than electrical circuits, as shown in FIG. 14. The sensing pathway 30 is formed in the opposing walls 41 by oppositely positioned light emitting and light receiving elements 51 and 52, with the gravity responsive member 12 being an opaque ball acting to block light reception between oppositely mounted emitter 51 and receiver 52 when the switch is in the proper alignment, thus breaking the circuit.

Movement of the gravity responsive element 12 within the switch can be slowed or damped by the addition of oil or a similar fluid. The sensitivity of the switch is affected by the depth of the pathway 30 and the size of the gravity responsive element 12.

Figure 17:
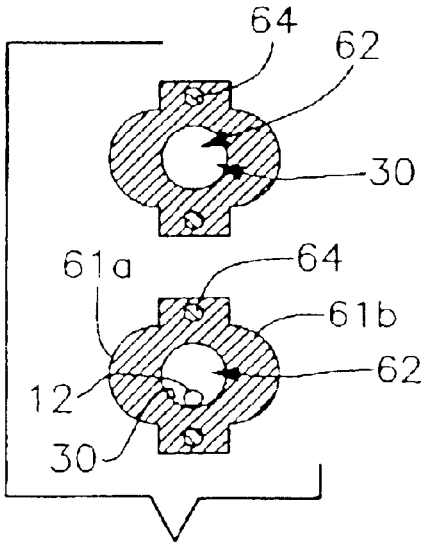
FIG. 17 is a transverse cross-sectional view of the switch of FIG. 15 taken along line XVII—XVII.
Figure 18:
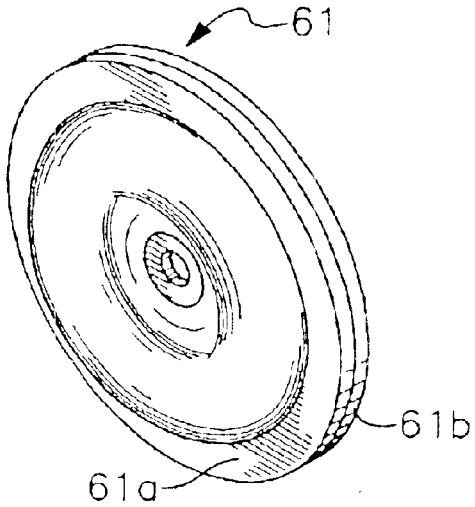
FIG. 18 is a perspective view of the switch configured as a 360 degree torus, circular in transverse cross-section.

An alternative tubular embodiment is illustrated in FIGS. 15 through 18, where the switch comprises a housing 61, which may be comprised of two mating halves 61*a* and 61*b* as shown, which defines a toroidal chamber 62. Chamber 62 is a 360 degree torus having a circular transverse cross-section, as seen in FIG. 17. In simpler terms, chamber 62 has the shape of a doughnut or ring. The housing halves 61*a* and 61*b* are provided with grooves 63 to receive O-rings 64 to seal in the gravity responsive member 12 when a liquid conducting material is used. As described above, various conductive elements such as pins or strips are positioned within the chamber 62 to define the three-axis sensing pathway 30. With the chamber extending completely full circle, the switch can function when rotated more than 360 degrees about the central axis of the housing 61.

While liquid mercury, being a metal in liquid form, works very well to complete the electrical circuit in the switch, mercury is a hazardous material and is therefore undesirable from a practical and environmental standpoint in some circumstances. An alternative embodiment for the gravity responsive member 12 is that of an electrically conductive liquid immersed within a non-conductive carrier liquid. The conductive liquid is immiscible in the carrier liquid and of a different specific gravity/density, such that the conductive liquid maintains a generally spherical shape within the carrier liquid. Thus the conductive liquid forms a ball or bead which remains cohesive within the carrier liquid, with the ball or bead being denser than the carrier liquid such that it remains at the bottom of the carrier liquid. By utilizing the combination of the conductive liquid to form the gravity responsive member 12 within the carrier liquid, less hazardous materials may be utilized. It is most preferred that the conductive liquid and the carrier liquid be relatively viscous, as this precludes separation of the conductive liquid ball if the switch is shaken. A preferred combination is that of ethylene or propylene glycol for the conductive liquid and a silicone oil for the carrier liquid. Other conductive liquids, such as silver nitrate or salt water for example, may be used. Toluene or benzene are examples of other possible carrier liquids.

Figure 31:
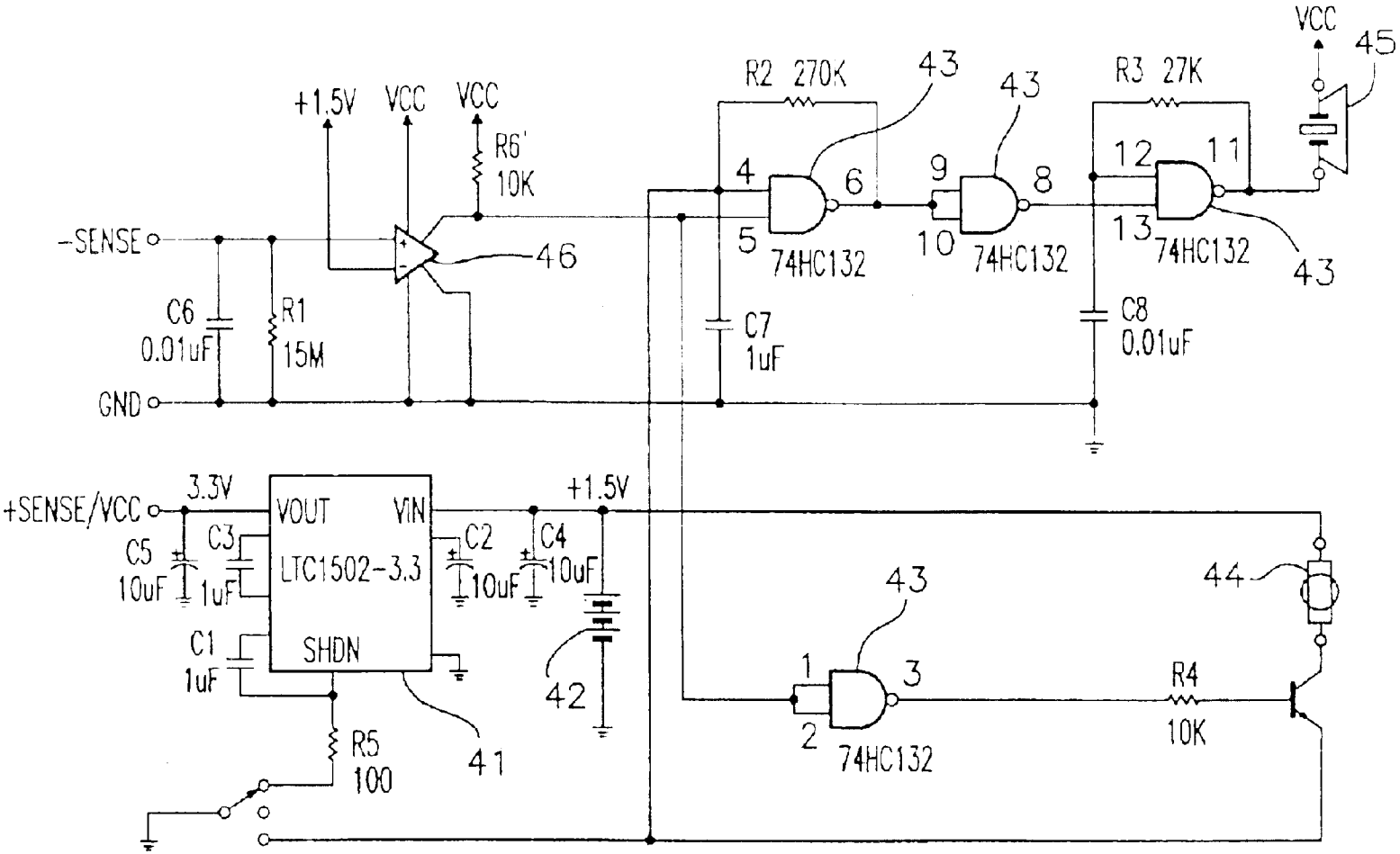
FIG. 31 is a schematic representation of a resistivity sensing circuit.

Because the conductive liquid materials used to replace the liquid mercury are typically much less conductive, it is most preferred that the switch utilize an electronic circuit to measure or sense the change in resistivity of the different liquids, with the electronic circuit then closing or opening a circuit for operational purposes in response to the different resistivity values. As shown in FIG. 31, which is a representative example of a battery powered resistivity sensing circuit, the resistivity sensing means 40 determines the status of the switch such that the switch is operational if the resistivity drops, which occurs when the conductive liquid bridges the gap in the sensing pathway 30. In this schematic element 41 is a DC to DC power supply chip to step up the voltage from the battery 42, element 43 is a quad nond-gate with Schmitt trigger inputs, and operative elements which as shown consist of a vibratory motor means 44 and an audible signal producing means 45. FIG. 11 further includes a comparator element 46 for sensitivity due to the high impedance of the electronic circuit 40.

Figure 19:
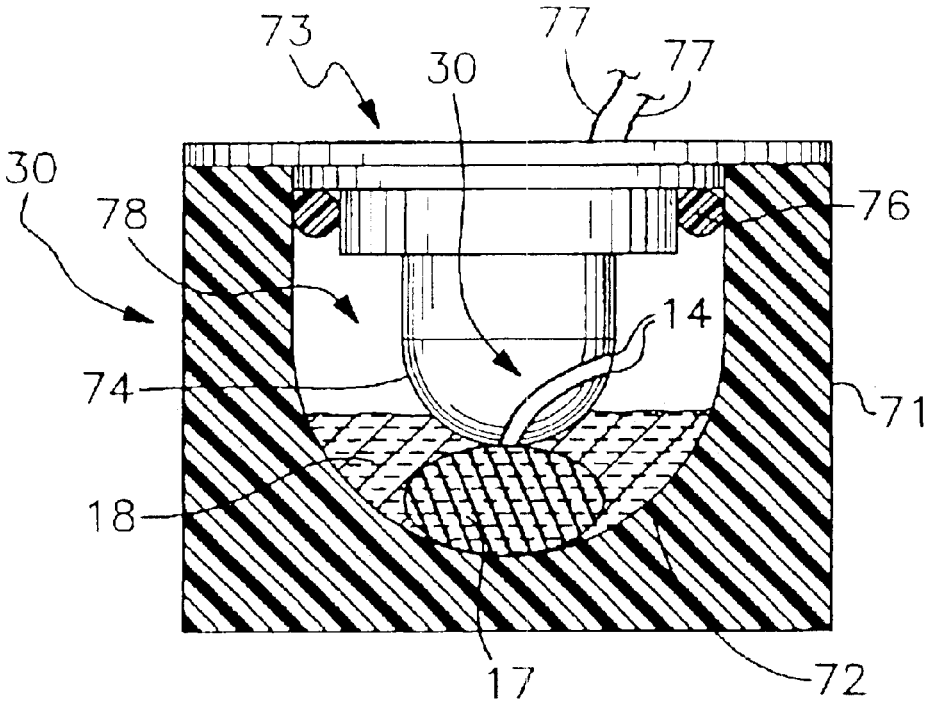
FIG. 19 is a view of a hemispherical chamber switch, with the base member, O-ring, gravity responsive conductive liquid and carrier liquid shown in cross-section, where the sensing pathway is formed as a pair of strips or wires embedded onto the surface of the interior member.

An alternative embodiment of a switch 70 having a hemispherical chamber 78 is illustrated in FIGS. 19 through 21, 28 and 29. The hemispherical switch 70 is formed preferably of a two parts, an outer body 71 and an inner member cap 73. Outer body 71 defines a concave chamber outer wall 72 which is hemispherical. The inner cap member has a sealing flange 75 which mates with the outer body 71 to form a sealed housing to retain a liquid gravity responsive member 12, which may comprise a single material but which is shown as a conductive liquid member 17 immersed within a carrier liquid 18, the liquid member 17 having a higher specific gravity or density than the carrier liquid 18, such that it remains as a bead or ball in the bottom of the carrier liquid 18. An O-ring 76 is disposed between the sealing flange 75 of the inner member cap 73 and the outer body 71. The inner member cap 73 most preferably terminates in a convex hemispherical chamber inner wall 74, such that the chamber 78 is defined by the separation between the chamber inner wall 74 and the chamber outer wall 72. In FIG. 19, the sensing pathway 30 is defined by a pair of strips 14, such as foil ribbons or wires positioned or formed on the chamber inner wall 74, with external leads 77 connected to the strips 14 and extending from the cap member 73. Alternatively, the strips 14 could be embedded in the chamber outer wall 72. In this embodiment the outer body 71 and the inner member cap 73 are formed of non-conductive material, such as PTFE or similar non-wetting plastics. When the switch 70 is disposed in physical space such that the sensing pathway 30 is in contact with the conductive liquid member 17, the circuit will be completed. When the switch 70 is disposed such that the sensing pathway 30 is not in contact with the conductive liquid 17, which always remains at the lowermost position due to gravity, the circuit is not completed. In the embodiment utilizing resistivity changes, the circuitry recognizes the difference in resistivity between the conductive liquid 17 and the carrier liquid 18 to determine whether the operational circuitry will be activated or not.

Figure 20:
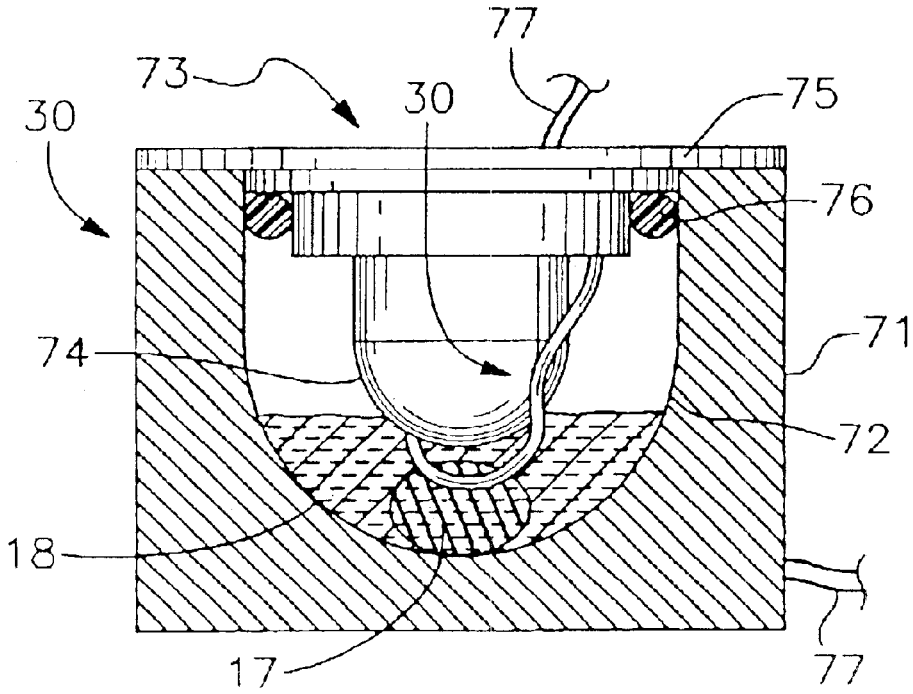
FIG. 20 is a view of a hemispherical chamber switch, similar to FIG. 19, where the sensing pathway is formed as a combination of a single wire disposed within the chamber, where the base member is composed of a conductive material.
Figure 29:
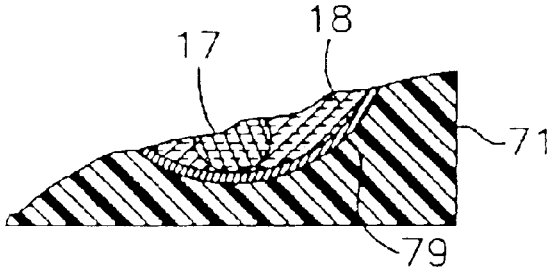
FIG. 29 is a partial view of a hemispherical switch similar to FIG. 27, where the outer chamber wall comprises a conductive layer.

In the embodiment shown in FIG. 20, the outer body 71 is formed of a conductive material, such as metal, or the chamber outer wall 72 is coated with a conductive layer 79, as shown in FIG. 29, with an external lead 77 provided which connects the chamber outer body 71 or the conductive layer 79 to the external circuitry. In this embodiment the sensing pathway 30 is defined by a single wire 15 disposed within the chamber 78, that is, separated or suspended from either the chamber inner wall 74 or the chamber outer wall 72 so that is resides within the chamber 78 interior. When the switch 70 is positioned such that the wire 15 is in contact with the conductive liquid member 17, the circuit is closed. Alternatively, the conductive layer 79 could be applied to the chamber inner wall 74 or the inner member 73 itself made of conductive material with the outer body 71 being non-conductive.

Figure 21:
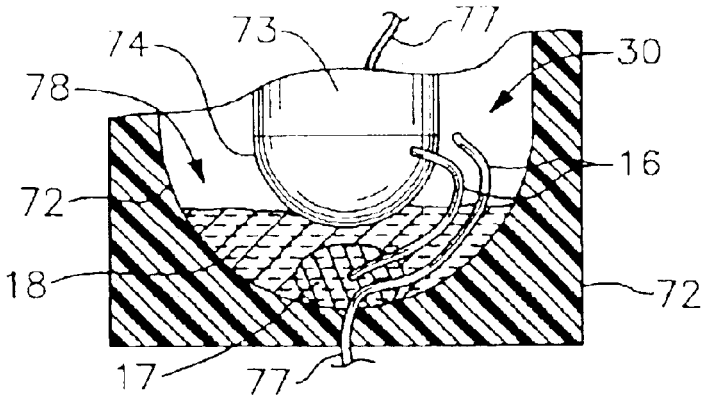
FIG. 21 is a partial view of a hemispherical chamber switch, similar to FIG. 19, where the sensing pathway is formed as a pair of wires disposed within the chamber.

In the embodiment shown in FIG. 21, the sensing pathway 30 is formed as a pair of disposed or suspended wires 16 which are positioned separated a distance from the chamber inner wall 74 and the chamber outer wall 72 and thus disposed within the interior of chamber 78. The wires 16 are substantially parallel, such that a circuit is completed when the conductive liquid member 17 is in contact with both wires 16. In the illustration, the wire pair 16 is shown where one wire 16 comes from the outer body 71 and the other wire 16 comes from the inner cap member 73, but both wires 16 could extend from the cap member 73 or both wires 16 could extend from the outer body 71.

Figure 28:
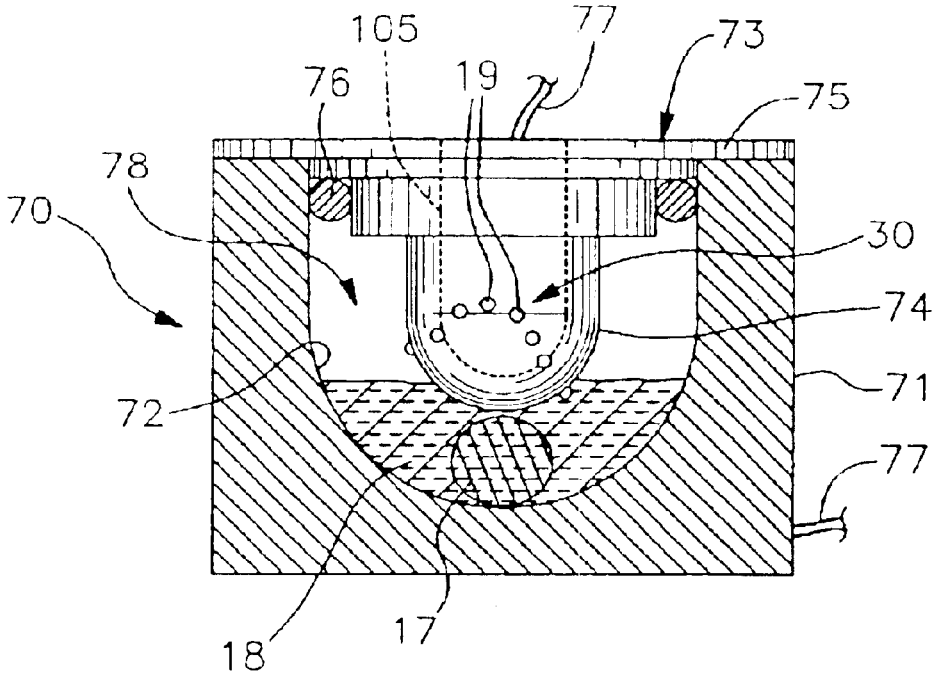
FIG. 28 is a view of a hemispherical chamber switch, similar to FIG. 19, where the sensing pathway is formed as a series of contact points on the chamber inner wall, where the base member is composed of a conductive material.

FIG. 28 shows a hemispherical switch 70 where the sensing pathway 30 is defined by a series of contact points 19. The contact points 19 are pins or post members inserted into the chamber inner wall 74 and are of sufficient length to extend completely through the chamber inner wall 74 and into bore 105 disposed within the inner member cap 73. The bore 105 is filled with solder or other conductive material and contacts the interior ends of the contact points 19. An external lead 77 is connected to solder. The outer body 72 is formed of a conductive material or provided with a conductive layer, as shown in FIG. 29. When the switch 70 is oriented such that any of the contact points touch the conductive liquid 17, the circuit is completed.

Figure 22:
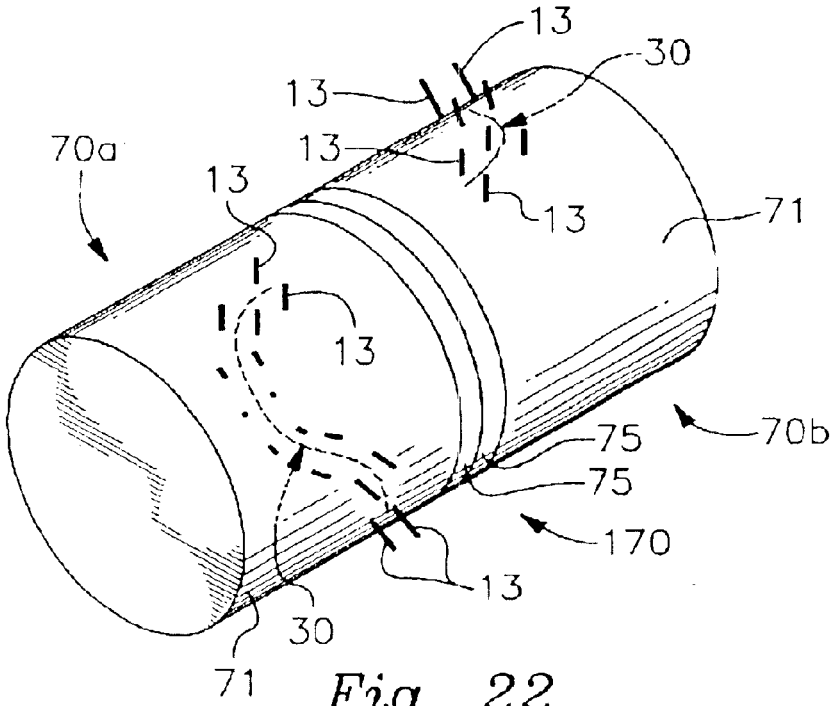
FIG. 22 is a perspective view of a pair of oppositely oriented hemispherical chamber switches, where the sensing pathway is formed by paired contact pins.

FIG. 22 shows a pair of hemispherical chamber switches 70*a* and 70*b* joined and oriented in opposite directions, where the sensing pathway 30, illustrated by a dashed line, is defined by pairs of electrical contact pin members 13 which are mounted in the outer body 71 of each switch 70. The pin members 13 extend into the chambers 78 to make contact with the gravity responsive member 12, which as stated is preferably a conductive liquid bead 17 disposed within a carrier liquid 18. The contact pin pairs 13 will be joined in an electrical circuit by conductive wire leads, not shown, in known manner. This construction allows the combination switch 170 to operate over a full 360 degrees in all axial directions. As the combination switch 170 is rotated, tilted, moved through space, etc., the pathway 30 defined by one of the individual switches 70*a* or 70*b* is always operational. For example, in FIG. 22, switch 70*a* would be operational. When the switch 170 is inverted such that switch 70*a* is no longer functioning, i.e., such that switch 70*b* occupies the lowermost relative position, the sensing pathway 30 of switch 70*b* becomes operational. Similar double switches having equivalent sensing pathways 30 can be formed using opposing strips 14, suspended wire pairs 16, a single suspended wire 15 in combination with a conductive layer 79 or outer body 71, etc., in the manner described elsewhere herein.

Figure 23:
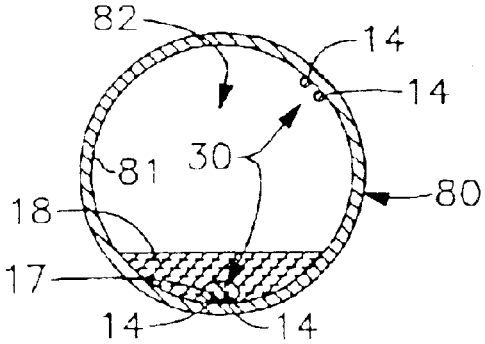
FIG. 23 is a cross-sectional view of a spherical switch, where the sensing pathway is formed by a pair of opposing strips.
Figure 24:
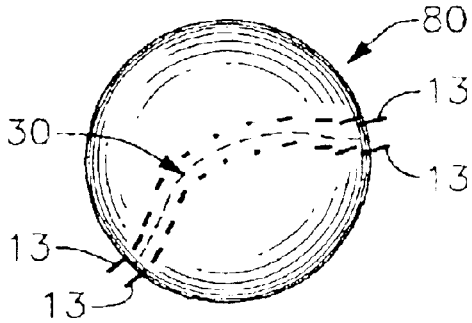
FIG. 24 is an external view of a spherical switch, where the sensing pathway is formed by pairs of contact pins.
Figure 25:
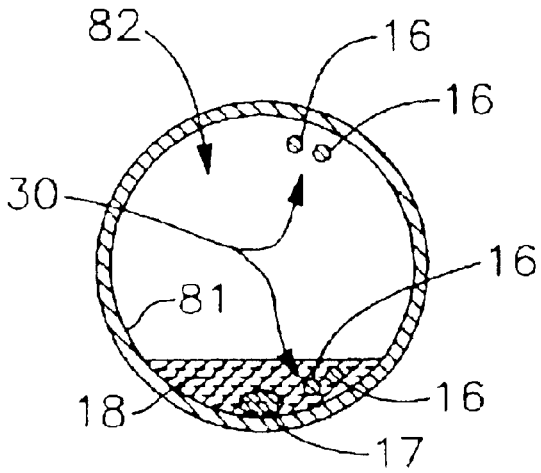
FIG. 25 is a cross-sectional view of a spherical switch, where the sensing pathway is formed by a pair of suspended wires.
Figure 26:
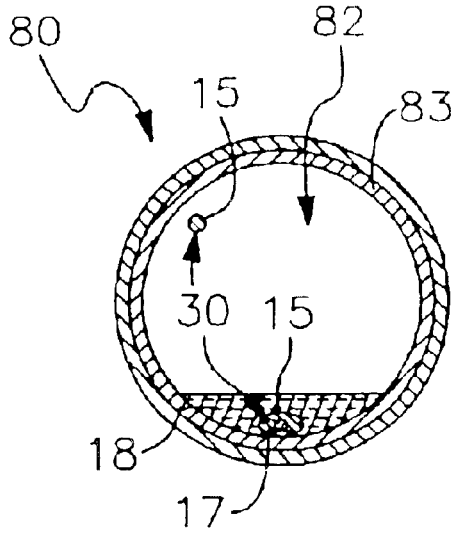
FIG. 26 is a cross-sectional view of a spherical switch, where the sensing pathway is formed by a suspended wire and the chamber outer wall is comprised of a conductive layer.

FIGS. 23 through 26 illustrate another embodiment for a spherical switch 80 operational over a 360 range in all axial directions. Here spherical switch 80 is a hollow sphere having an internal chamber wall 81 defining a spherical interior chamber 82. The sensing pathways 30 are formed within the chamber 82 by any of the described means, such as paired contact pins 13, as shown in FIG. 24, embedded pairs of strips or wires 14, as shown in FIG. 23, or suspended wire pairs 15, as shown in FIG. 25. The electrical circuit is closed when the switch 80 is rotated so that the conductive liquid bead 17 fills the gap between the conductive members. FIG. 26 shows a switch 80 having a conductive interior layer 83 and a single suspended wire contact 15, where the circuit is completed when switch 80 is positioned so that the conductive liquid bead 17 fills the gap between the wire contact 15 and the conductive interior layer 83. In all the embodiments, the contact members are connected in known manner to create an electrical circuit.

Figure 27:
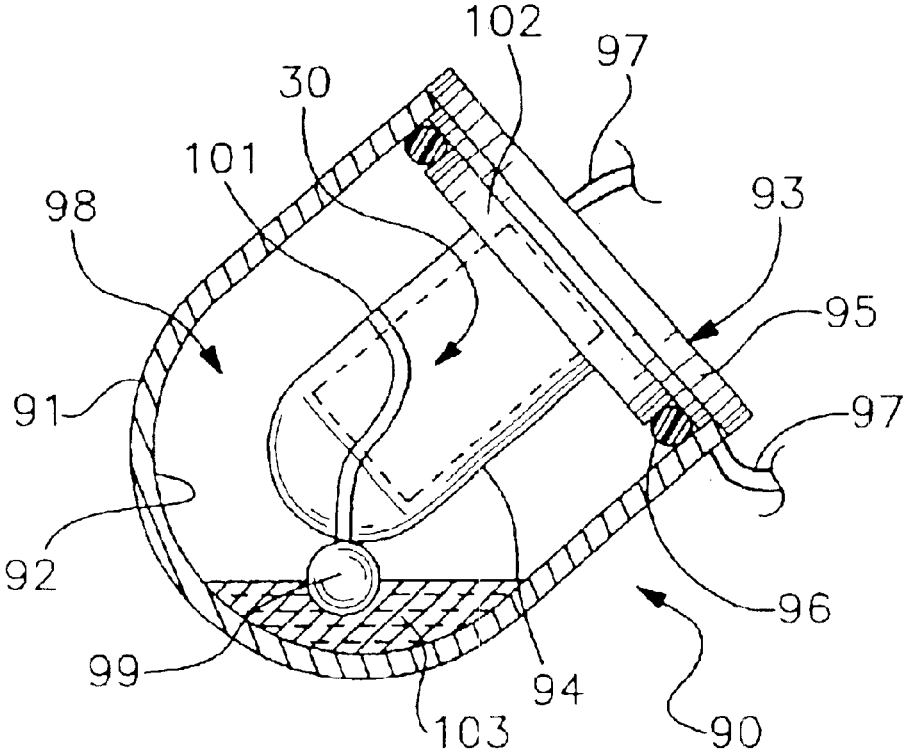
FIG. 27 is a cross-sectional view of a hemispherical switch where a magnet retains a metal ball in contact with the chamber inner wall and a conductive liquid is used to complete a circuit when the ball is in contact with a sensing pathway.

Another embodiment for the three axis switch is shown in FIG. 27. Switch 90 incorporates a magnet 102 disposed within the chamber inner wall 94 of an inner cap member 93, which comprises a sealing flange 95 to mate with an outer body 91 in sealing manner with O-ring 96. The outer body 91 is formed of a conductive material, or a conductive layer is provided on the chamber outer wall 92. A strip 101 composed of a conductive material, such as a metal foil, is embedded on the surface of the chamber inner wall 94 to define the sensing pathway 30. External leads 97 connect to the outer body 91 and the conductive strip 101. A metal ball 99 is disposed against the chamber inner wall 94, where it is held in contact with and suspended from the chamber inner wall 94 by the magnet 102. The metal ball 99 will always occupy the lowermost zero gravity position due to gravity effects as the switch 90 is turned. A conductive liquid 103 is placed into the chamber 98, the liquid 103 being sufficient in quantity to bridge the gap between the metal ball 99 and the chamber outer wall 92, but not in such quantity that the gap between the chamber inner wall 94 and the chamber outer wall 92 is bridged. When the switch 90 is oriented such that the metal ball 99 contacts the foil strip 101, the circuit to the chamber outer wall 92 is completed by the conductive liquid 103. When the switch 90 is oriented such that the metal ball 99 does not contact the strip 101, the circuit is open.

Figure 32:
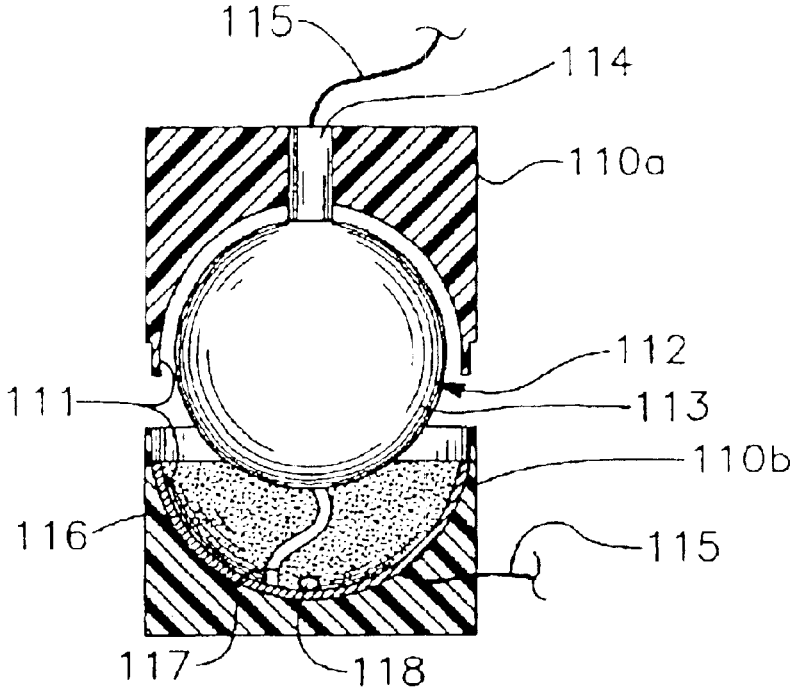
FIG. 32 is a cross-sectional view of a spherical switch, where the sensing pathway is formed by application of a conductive coating onto the outer chamber wall.
Figure 33:
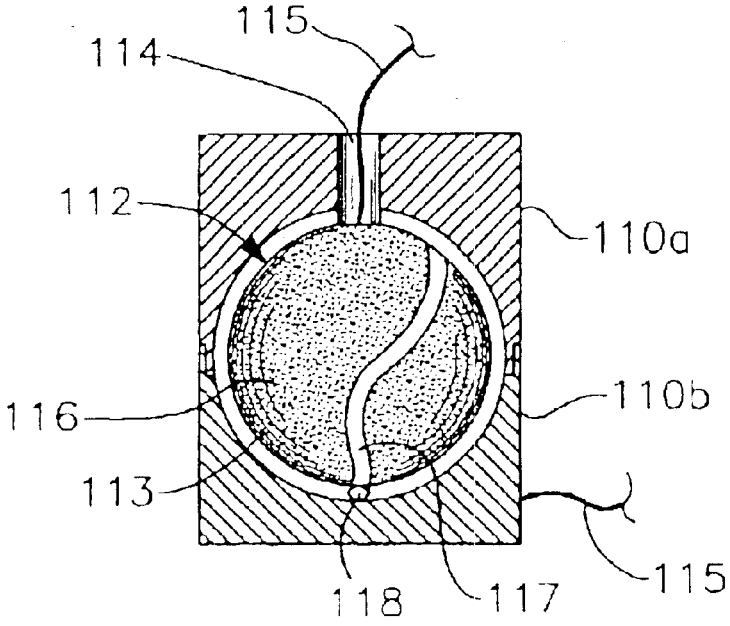
FIG. 33 is a cross-sectional view of a spherical switch, where the sensing pathway is formed by application of a conductive coating onto the inner chamber wall formed by the spherical member.

FIGS. 32 and 33 illustrate still another embodiment for a three axis switch. These embodiments comprise a two-part housing 110*a* and 110*b* which together define an outer spherical chamber wall 111. A spherical member 112 defines the inner chamber wall 113. In the embodiment of FIG. 32, the housing 110 is composed of a non-conductive material, such as plastic, while the spherical member 112 is composed of a conductive material, such as metal. The spherical member 112 is properly positioned by post member 114, which is also composed of conductive material. A lead wire 115 is connected to the conductive post member 114. Alternatively, the lead wire 115 may be connected directly to the conductive spherical member 112. The inner chamber wall 113 is provided with a conductive coating layer 116, which may be applied by spraying, by direct application, by staining or any other known technique suitable for depositing a conductive coating onto a plastic or non-conductive surface. The sensing pathway 117 is provided by omitting the conductive coating layer 116 over the desired course. A second conductive lead wire 115 is connected to the conductive coating layer 116. When the gravity responsive member 118 is located within the pathway, the circuit remains open. When the switch is moved such that the gravity responsive member 118 is located out of the pathway 117, the gravity responsive member 118 contacts both the conductive coating layer 116 and the conductive spherical member 112 and the circuit is closed. The conductive coating layer 116 may comprise any suitably conductive material, such as a graphite-containing composition or a conductive ink. In an alternative embodiment as shown in FIG. 33, the housing 110 is composed of a conductive material and the spherical member 112 is composed of a nonconductive material, with the conductive coating layer 116 applied to the spherical member 112 in a manner which defines a sensing pathway 117, with the lead wire 115 connected to the conductive coating later 116. As before described in other embodiments, it is also possible to form the sensing pathway 117 itself as the conductive component, by spraying, painting or otherwise depositing the conductive coating layer 116 onto the desired surface. In this embodiment the circuit remains closed as long as the gravity responsive element 118 remains in contact with the sensing pathway 117. The use of a sprayed, painted, stained or otherwise deposited conductive coating is also applicable to other types of housing configurations previously discussed.

As seen in FIGS. 34 through 36, the preferred embodiment of the invention is shown where the switch 300 is disposed within an external or secondary housing 301, in an adjustable or displaceable manner relative to the secondary housing 301, which is adapted either for direct attachment to an object, as shown, or for mounting to or within another object or housing which is then possibly attached to a second object or piece of equipment. The secondary housing 301 is shown for illustration purposes herein as having a generally elongated body having generally C-shaped clip members 302 mounted thereon for attachment of the secondary housing 301 to the shaft or grip portion of a golf club. The particular shape and configuration of the secondary housing 301 will vary depending on the application. The switch 300 is preferably of a spherical or hemispherical type having a cylindrical exterior configuration as described above, although any of the other embodiments may also be utilized with suitable adaptation, with the conductive components residing in the spheroidal portion 303 of the secondary housing 301. The switch 300 is mounted in a pivoting or rotating manner about an axis 306 defined by pivoting means 310, such as by mounting the switch 300 within a bore or sleeve 307 internally disposed on the spheroidal portion 303 (FIG. 35) or by providing axial posts 308 or recesses 309 on each end of the switch 300 with corresponding members on the spheroidal portion 303 (FIG. 36), such that it may be rotated about the axis 306 relative to the secondary housing 301 by movement of the adjustment member 304, which extends through a slot 305 disposed in the secondary housing 301.

In this manner the orientation of the sensing pathway can be altered about the axis 309 when the orientation of the secondary housing 301, by virtue of a change in the object to which it is attached, is altered. For example, where the switch 300 is utilized to define a proper swing plane for a golf club, as previously described in my U.S. Pat. No. 5,911,635, the disclosure of which is incorporated herein by reference, the switch 300 can be adjusted relative to the housing 301 in response to the length of the club that the secondary housing 301 is attached to—the longer clubs, such as drivers, woods and long irons, requiring a more horizontal swing plane than the shorter clubs, such as the short irons and wedges—by properly positioning the adjustment member 304 in the slot 305. Thus, rather than requiring a different sensor device for the different clubs, the same sensor device can be used for the entire set. Obviously, a switch 300 relatively adjustable to a secondary housing 301 will also have applications in numerous other settings where it is desirable to adjust the orientation of the switch 300 relative to a secondary housing 301.

It is contemplated and understood that equivalents and substitutions to certain elements set forth above may be obvious to those skilled in the art, and thus the true scope and definition of the invention is to be as set forth in the following claims.

I claim:

1. A gravity responsive attitude sensing device which controls a circuit in response to positioning the device relative to true vertical comprising:

a housing adapted to be mounted to an object;

a switch disposed within said housing, said switch comprising a chamber, a conductive pathway disposed within said chamber, and a gravity responsive member free to move within said chamber whereby said gravity responsive member, dependent on the orientation of said switch relative to true vertical, either contacts said pathway forming a closed circuit or does not contact said pathway leaving an open circuit, whereby said pathway defines a course of rotation for said switch over all three axial directions regardless of whether said switch remains fixed in space or is moved through space as its position is changed; and pivot means defining a pivot axis, whereby the orientation of said switch relative to said housing is adjustable by pivoting said switch about said pivot axis;

said housing further comprising clip members to connect said housing to said object.

2. The device of claim 1, wherein said pivot means comprises a bore disposed within said housing, said switch having a generally cylindrical external configuration and mounted within said bore.

3. The device of claim 1, wherein said pivot means comprises a post and a recess to receive said post.

4. The device of claim 1, wherein said object comprises a golf club shaft.

5. The device of claim 1, wherein said chamber is defined by a concave hemispherical outer wall and a convex hemispherical inner wall.

6. The device of claim 1, said switch further comprising an adjustment member.

7. The device of claim 1, wherein said chamber is defined by opposing curved walls.

8. A gravity responsive attitude sensing device which controls a circuit in response to positioning the device relative to true vertical comprising:

a housing adapted to be mounted to an object;

a switch disposed within said housing, said switch comprising a chamber, a conductive pathway disposed within said chamber, and a gravity responsive member free to move within said chamber whereby said gravity responsive member, dependent on the orientation of said switch relative to true vertical, either contacts said pathway forming a closed circuit or does not contact said pathway leaving an open circuit, whereby said pathway defines a course of rotation for said switch over all three axial directions regardless of whether said switch remains fixed in space or is moved through space as its position is changed; and pivot means defining a pivot axis, whereby the orientation of said switch relative to said housing is adjustable by pivoting said switch about said pivot axis;

wherein said chamber has a non-conductive spherical outer wall and a conductive spherical inner wall, and wherein said pathway comprises a conductive coating layer applied to said spherical outer wall.

9. The device of claim 8, wherein said pivot means comprises a bore disposed within said housing, said switch having a generally cylindrical external configuration and mounted within said bore.

10. The device of claim 8, wherein said pivot means comprises a post and a recess to receive said post.

11. The device of claim 8, wherein said object comprises a golf club shaft.

12. The device of claim 8, said switch further comprising an adjustment member.

13. A gravity responsive attitude sensing device which controls a circuit in response to positioning the device relative to true vertical comprising:

a housing adapted to be mounted to an object;

a switch disposed within said housing, said switch comprising a chamber, a conductive pathway disposed within said chamber, and a gravity responsive member free to move within said chamber whereby said gravity responsive member, dependent on the orientation of said switch relative to true vertical, either contacts said pathway forming a closed circuit or does not contact said pathway leaving an open circuit, whereby said pathway defines a course of rotation for said switch over all three axial directions regardless of whether said switch remains fixed in space or is moved through space as its position is changed; and pivot means defining a pivot axis, whereby the orientation of said switch relative to said housing is adjustable by pivoting said switch about said pivot axis;

wherein said chamber has a conductive spherical outer wall and a non-conductive spherical inner wall, and wherein said pathway comprises a conductive coating layer applied to said spherical inner wall.

14. The device of claim 13, wherein said pivot means comprises a bore disposed within said housing, said switch having a generally cylindrical external configuration and mounted within said bore.

15. The device of claim 13, wherein said pivot means comprises a post and a recess to receive said post.

16. The device of claim 13, wherein said object comprises a golf club shaft.

17. The device of claim 13, said switch further comprising an adjustment member.

18. A gravity responsive attitude sensing device which controls a circuit in response to positioning the device relative to true vertical comprising:

a housing adapted to be mounted to an object;

a switch disposed within said housing, said switch comprising a chamber, a conductive pathway disposed within said chamber, and a gravity responsive member free to move within said chamber whereby said gravity responsive member, dependent on the orientation of said switch relative to true vertical, either contacts said pathway forming a closed circuit or does not contact said pathway leaving an open circuit, whereby said pathway defines a course of rotation for said switch over all three axial directions regardless of whether said switch remains fixed in space or is moved through space as its position is changed; and pivot means defining a pivot axis, whereby the orientation of said switch relative to said housing is adjustable by pivoting said switch about said pivot axis;

wherein said chamber has a conductive concave hemispherical outer wall and a non-conductive convex hemispherical inner wall, said device further comprising a magnet disposed within said inner wall, wherein said pathway is disposed on said inner wall, wherein said gravity responsive member comprises an electrically conductive metal ball, whereby said magnet retains said ball suspended from and in contact with said inner wall, said device further comprising an electrically conductive liquid disposed within said chamber in sufficient quantity to contact said ball but not said inner wall, thereby electrically connecting said ball to said outer wall.

19. The device of claim 18, wherein said pivot means comprises a bore disposed within said housing, said switch having a generally cylindrical external configuration and mounted within said bore.

20. The device of claim 18, wherein said pivot means comprises a post and a recess to receive said post.

21. The device of claim 18, wherein said object comprises a golf club shaft.

22. The device of claim 18, said switch further comprising an adjustment member.

* * * * *